US008378559B2

(12) United States Patent
Shuja et al.

(10) Patent No.: US 8,378,559 B2
(45) Date of Patent: Feb. 19, 2013

(54) LED BULB FOR HIGH INTENSITY DISCHARGE BULB REPLACEMENT

(75) Inventors: Ahmed Shuja, San Francisco, CA (US); Tom Griffin, San Ramon, CA (US); Praveen Medis, Moroga, CA (US); Phil Craine, Saratoga, CA (US)

(73) Assignee: Progressive Cooling Solutions, Inc., Hayward, CA (US)

( * ) Notice: Subject to any disclaimer, the term of this patent is extended or adjusted under 35 U.S.C. 154(b) by 0 days.

(21) Appl. No.: 12/860,707

(22) Filed: Aug. 20, 2010

(65) Prior Publication Data

US 2011/0043092 A1 Feb. 24, 2011

Related U.S. Application Data

(60) Provisional application No. 61/235,661, filed on Aug. 20, 2009.

(51) Int. Cl.
*H01J 1/02* (2006.01)

(52) U.S. Cl. ..... 313/34; 362/373; 362/294; 362/800; 313/46

(58) Field of Classification Search ..... 257/40, 257/72, 98–100, 642–643, 759; 313/498–512, 313/46; 315/169.1, 169.3; 427/58, 64, 66, 427/532–535, 539; 428/690–691, 917; 438/26–29, 438/34, 82, 455; 445/24–25; 362/543–549, 362/555, 800, 249.01–249.03
See application file for complete search history.

(56) References Cited

U.S. PATENT DOCUMENTS

| | | | | |
|---|---|---|---|---|
| 7,210,832 | B2 * | 5/2007 | Huang | 362/547 |
| 7,847,471 | B2 * | 12/2010 | Liu et al. | 313/46 |
| 7,852,015 | B1 * | 12/2010 | Yen et al. | 315/291 |
| 2005/0258438 | A1 * | 11/2005 | Arik et al. | 257/88 |
| 2006/0071222 | A1 * | 4/2006 | Yatsuda et al. | 257/90 |
| 2006/0196651 | A1 * | 9/2006 | Board et al. | 165/177 |
| 2008/0128898 | A1 * | 6/2008 | Henderson et al. | 257/713 |
| 2008/0290363 | A1 * | 11/2008 | Lin et al. | 257/99 |
| 2009/0315062 | A1 * | 12/2009 | Su et al. | 257/99 |
| 2010/0127299 | A1 * | 5/2010 | Smith et al. | 257/99 |
| 2011/0037409 | A1 * | 2/2011 | Van De Ven et al. | 315/294 |

* cited by examiner

*Primary Examiner* — Mariceli Santiago
*Assistant Examiner* — Donald Raleigh
(74) *Attorney, Agent, or Firm* — Perkins Coie LLP

(57) ABSTRACT

The disclosed system includes a two-phase cooling apparatus configured for cooling an array of LED dies.

20 Claims, 6 Drawing Sheets

2A

2B

3A

3B

LED BULB FOR HIGH INTENSITY DISCHARGE BULB REPLACEMENT

CLAIM OF PRIORITY

This application claims priority to U.S. Provisional Patent Application No. 61/235,661 entitled "COOLING TECHNOLOGY ENABLED METAL HALIDE REPLACEMENT WITH LED LUMINAIRE", which was filed on Aug. 20, 2009, the contents of which are expressly incorporated by reference herein.

BACKGROUND

The MH lamp is a type of high intensity discharge (HID) lamp in which most of the light is produced by radiation of metal halide and mercury vapors in the arc tube. In 1961, Gilbert Reiling patented the first metal halide (MH) lamp but discharge lighting can trace its roots all the way to the 1800's when Sir Humphrey Davy demonstrated a discharge lamp. This first metal halide lamp demonstrated an increase of lamp efficacy and color properties over Mercury Vapor, which made it more suitable for commercial, street and industrial lighting. These lamps are available in clear and phosphor-coated lamps. The MH is currently the predominate light source for high bay lighting applications and typically has efficacy of 70-90 lm/W.

The ubiquitous use of high bay metal halide lights is common because they are relative efficient light sources and there is currently no viable alternative to reproduce similar light levels from a compact source of tens of thousands of lumens. The widespread use happens despite the fact that this type of light source can consume a great deal of energy. MB and other HID lamps are highly compact sources of light that require special power supplies or ballasts to provide a regulated supply of electricity for starting and maintaining a constant current during bulb operation. Since the metal halide bulbs invention in the 1960's additional improvements of the metal halide lighting have centered on the ballast technology. This has lead up to the most current ballast improvements of digital ballasts introduced only at end of the last century. Even with the recent ballast technology advances that have shown pulse start and digital ballast to be more efficient than magnetic ballasts, adoption is slow since digital ballasts cost 6× more than magnetic ballasts. Overall there is no indication that the MH bulb technology will see significant advances in efficacy in the coming years. Also the HID/MH lamps and their arc tubes operate at extremely high temperatures and can shatter if adequate precautions are not taken. This is compounded by the fact that MH bulbs can act as radiant heaters heating the surrounding air. and this heat must be extracted by HVAC exasperating rising energy costs.

It is believed that one day solid state lighting (SSL) will be capable of competing with HID and MH lighting. As of today SSL alternatives suffered from low LED efficacy and thermal management issues. Recently alternative lamp sources have begun to make in-roads in the market for high bay lighting. The Linear Florescent Lamps (LFL) in the form of super T8 and T5 bulbs have been introduced for gaining energy savings. This alternative product selection comes with issues such as reduced lumen output at room temperatures above 68° F. and typically 6× the maintenance cost of a metal halide fixture. It is anticipated that the fluorescent technologies are an intermediate step to the eventual adoption of SSL. Alternatives to the MH are High Pressure Sodium (HPS) and Low Pressure Sodium (LPS) but these lamp sources have begun to be phased out due to limited lifetime, poor CRI and expensive bulb replacement. Also MH bulbs typically burn out every 10-12K hours driving US building owners to replace millions of metal halide bulbs annually.

The area of high bay lighting to date has seen little penetration by LED Luminaries that are direct fixture replacements of metal halide fixtures. The current products offered are large heavy light sources that are typically more then 10-100× more expensive than the existing metal halide fixture. One issue with LED high bay fixture replacement has to date been how to recreate light patterns and levels of existing MH fixtures. Due to thermal design the LED luminaries typically have large square flat light sources consisting of many LEDs. This complicates optical design and how to most effectively design LED luminaries that can recreate comparable color temperature, light distribution and light intensity so that preexisting building electrical grids can be preserved. Also since the light output per LED is limited by thermal design the number of LEDs to produce greater than ten thousand lumens makes the luminaire 10× more expensive than typical MH fixtures.

In this patent a new type of light source termed an Integrated LED Fixture (ILF) is disclosed that can act as a direct metal halide bulb replacement. A ILF design that can replace the MH bulb instead of the entire fixture is ideal for many reasons including but not limited to reduced cost, and ease of instillation. The current prior art leaves makes it difficult to achieve the goal of creating a MH bulb replacement. First compact LED arrays with high luminous flux capable of extreme brightness are not commercially available. This extreme brightness can be defined as a small emission area such as one square inch that is capable of greater than 10,000 lm. This type of LED modules that produce tens of thousands of lumens could be widely applicable to streetlighting, high-bay lighting, or even automotive lighting. The extreme brightness LED light modules are limited in commercial viability due to lack of thermal management systems that can keep the LED dies below a maximum junction temperature. The current invention solves these issue and makes the retrofit example viable.

In industrial and commercial space when MH bulb replacements occur the electrical grid and the necessary floor lighting pattern pre-exists and is expensive to alter. Consequently, in order to provide a retrofit compatible integrated LED lamp the light source must produce the same lumen output and similar illumination pattern on the floor. If the LED light source can be made into a dense array then simple glass or acrylic secondary optics can be used to shape the light to match previous metal halide light distribution. With an extreme brightness array a modular system can be arrived at where a single LED source can provide many different beam diameters and shapes.

The most typical high bay light based on metal halide bulb technology can produce 15,000-20,000 mean lumens for the right illumination level at a work surface 3-30 foot candle depending on mounting height. Thus for a LED light source with a efficacy of 80-100 lm/W a typical thermal heat flux could range from 150-250 W. This thermal energy comes in the form of phonons moving through a semiconductor lattice and must be handle through conduction from the back of the LED package. This electrical energy is typically only half the energy utilized by a metal halide bulb of equivalent lumen count but within the metal halide bulb the waste heat energy (~90% of the energy) is released by electromagnetic radiation. Further complications exist in the fact that fans are not permitted in high bay lighting applications due to reliability and noise concerns. Within any semiconductor thermal application where greater than 100 W of thermal energy must be released the challenge is nearly insurmountable. For example in LED fixtures currently on the market if 150 W of thermal power must be dissipated the heat sink alone can weigh upwards of 50 lbs. This far exceeds the weight limit for MH fixture mogul base which must be less than 5 lbs.

The Loop Heat Pipe (LHP) is a two-phase heat-transfer device with capillary pumping of the working fluid that is utilized in the ILF for thermal control of extreme brightness LED arrays. The LHP device consists of an evaporator, a condenser, a liquid reservoir, and separate liquid and vapor lines. In operation the liquid medium is converted to vapor at the evaporator and is then converted back to a liquid at the condenser so that the heat at the evaporator is mostly converted into latent heat of phase transformation and is dumped at the condenser by the reverse process in an essentially adiabatic process. The pressure of vaporization is larger than the pressure of condensation, and hence the vapor flows from the evaporator to the condenser with no additional power input. Consequently, the LHP is passive in that it operates on waste heat. This passive transport of a working fluid is achieved by capillary pumping of a wick structure, which is located in the evaporator. The wick can act as the "engine" in the LHP as long as the external pressure drop in the loop does not exceed the internal pressure drop across the wick structure (resulting from the wetting hydrophilic nature of the interior of the wick surface causing a meniscus film across the wick structure). The entire cycle of evaporation and condensation occurs in this sealed, evacuated loop.

The flat evaporator architecture of LHP is created to quickly integrate with extreme brightness LED modules. The attachment is made with a thermal interface material between a metal core board and the evaporator packaging plane. This quickly reconfigurable connection is both low thermal resistance and easily reworked.

DETAILED DESCRIPTION

Figure 1:
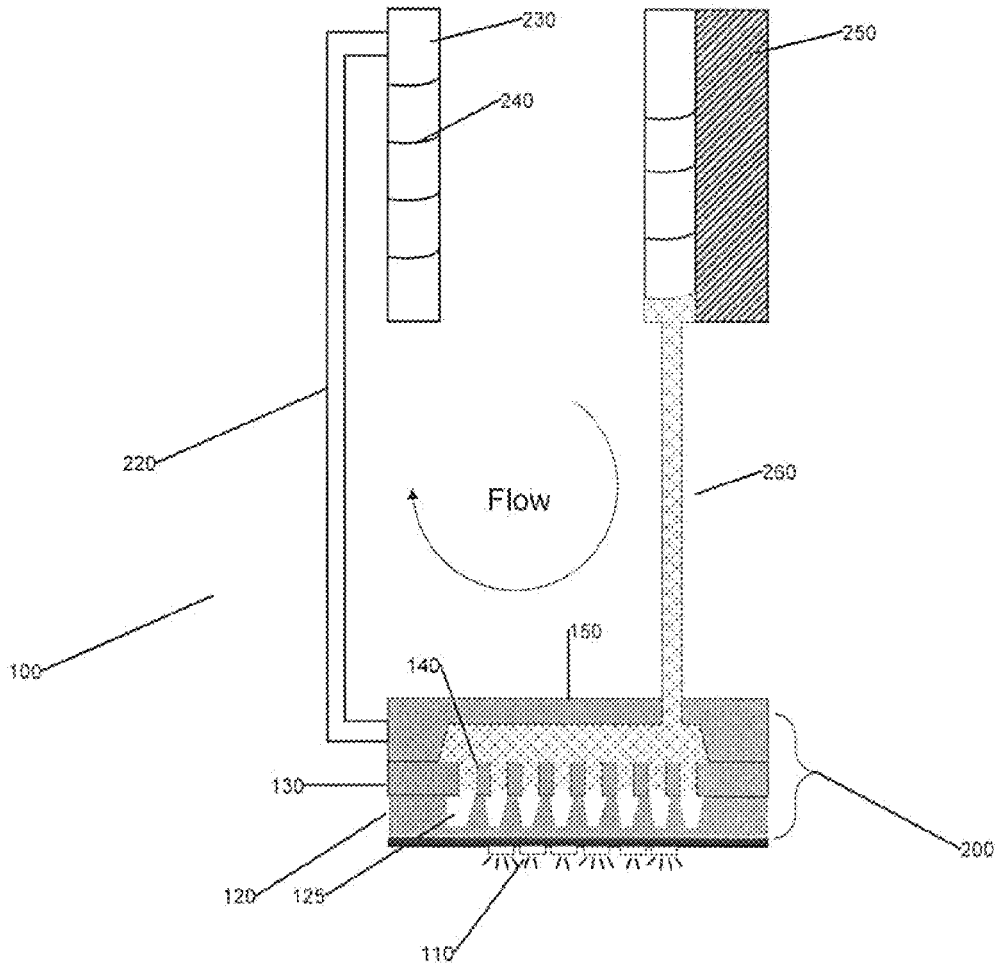
FIG. 1 illustrates a system view of a two-phase cooling apparatus configured for cooling an array of LED dies, according to one embodiment.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions will control.

Embodiments of the present disclosure include configurations that enable the replacement of MH bulbs with Integrated LED Fixtures that incorporate two-phase cooling apparatus.

FIG. 1 illustrates an example of the thermo-mechanical design of an LED lighting apparatus 100 comprising a two-phase cooling apparatus, according to one embodiment. This illustration does not show a power supply, or housing but these parts are necessary for operation.

The thermo-mechanical design of the LED lighting apparatus 100 can include an LED or an array of LEDs 110 coupled to the two-phase cooling apparatus. The two-phase cooling apparatus can include an evaporator 200, a vapor line 220, a heat sink 250, and/or a liquid return line 260. The vapor line 220 can transport vapor to a condenser 230 embedded in the heat sink 250.

In one embodiment, the LED or array of LEDs 110 are integrated with the evaporator 200 of the two-phase cooling apparatus with surface mount package technology. In another embodiment the LEDs array 110 can be mounted to the evaporator by chip on board technology.

In the cross sectional view, the LED dies 110 can be seen to be directly packaged on/integrated with the evaporator 200. In this integrated LED fixture (ILF) the heat generated by the LED die 110 conducts through a top cap layer 120 to a layer 130 having pore or capillary structures 140. Vapor is generated from absorption of heat emitted from the LED dies 110 by the liquid supplied by the chamber 150. The generated vapor can then exit the evaporator 200 through the spaces 125 formed in the top cap 120. The vapor moves along the top cap 120 layer and can manifold to the vapor line 220 where the vapor can be transported to the condenser 230.

Within the condenser 230, the vapor acts to spread heat along the heat sink surface to make it nearly isothermal as it condensed on the interior surface. In one embodiment, a series of spiraling fins 240 within the condenser 230 act to increase the vapor path length ensuring condensation and gravity is utilized to cause the condensed liquid to flow down toward the evaporator. As the vapor within the condenser 230 loses heat it changes phase back to liquid. The ease of condensation of the vapor can be enhanced by the heat sink 250 as it adds additional surface area for convective heat transfer. After the vapor has experienced phase change to fluid, the fluid is delivered back to the evaporator package via a liquid line 260. The heat from the interior of the condenser 230 can subsequently transfer to the metal fins 250 of the heat sink where it can be dissipated to the ambient air. The fluid is circulated to the liquid chamber 150 by liquid line 260.

Figure 2:
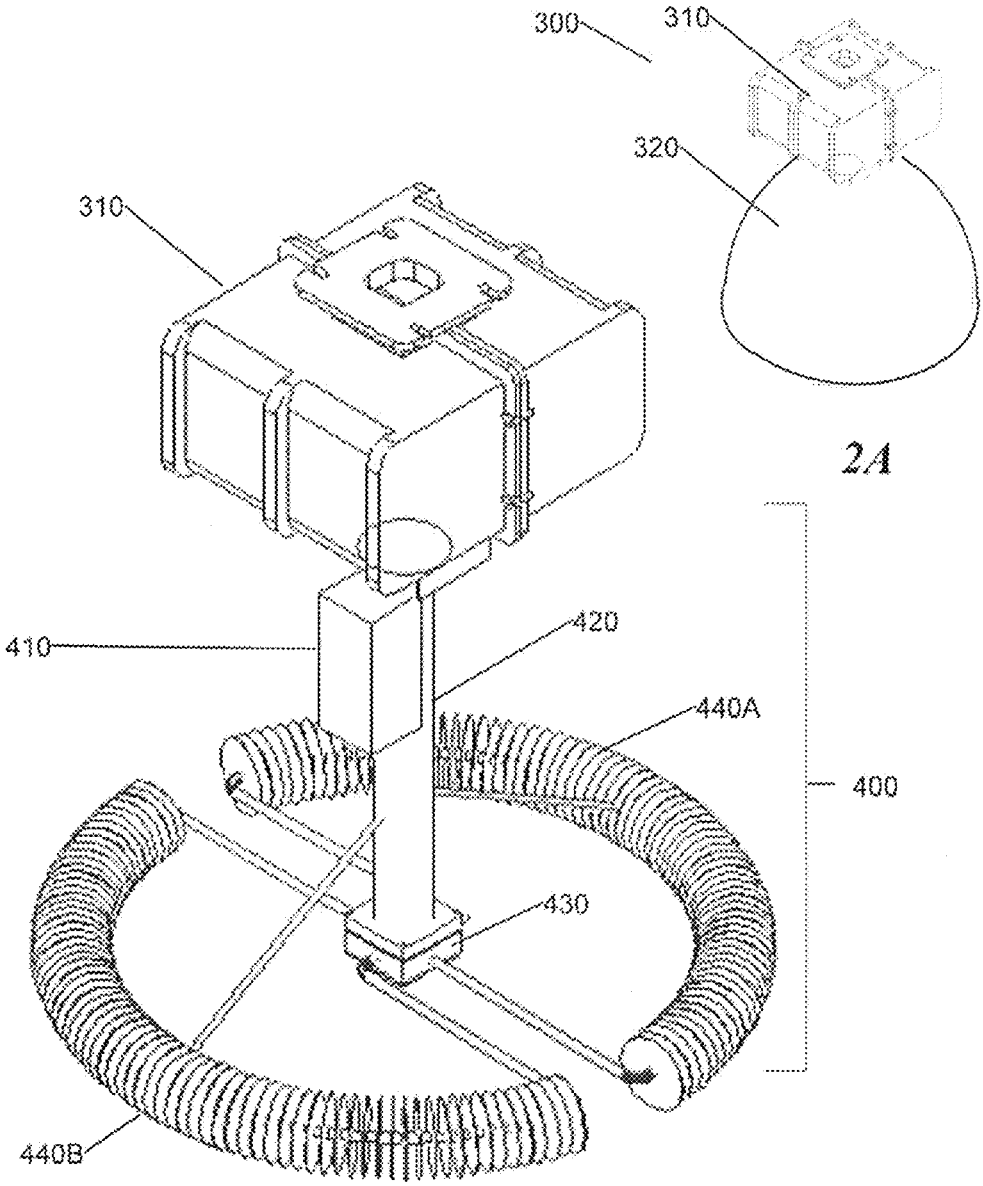
FIG. 2A illustrates a common metal halide fixture that is applied in high bay lighting applications.
FIG. 2B the reflector has been removed from the high bay light fixture to illustrate a Integrated LED Fixture (ILF) 400 that can directly replace a metal halide bulb.

FIG. 2A illustrates a common metal halide fixture that is applied in high bay lighting applications. The metal halide fixture 300 consists of a light reflector 320 and ballast 310. This light fixture type is mounted to be used in lighting applications where high intensity light must be created. The fixture itself can be thirty five to fifty pounds due to the ballast 310 containing a large magnetic coil. The ballast is typically supplied between 230V-120V AC which is then fed to a metal halide bulb that is screwed into the 310 ballast. The ballast acts to regulate the metal halide bulb by supplying a constant current after the plasma within the bulb has been generated.

FIG. 2B the reflector has been removed from the high bay light fixture to illustrate an Integrated LED Fixture (ILF) 400 that can directly replace a metal halide bulb. The ILF system 400 interfaces with the metal halide fixture 300 by being screwed into the ballast 310 by way of an E39 socket. The ILF System 400 consists of a power supply 410 that accepts the 120V AC signal from the ballast. The on board power supply 410 must convert the AC signal to a constant current DC signal. The power supply 410 must filter any instantaneous current spikes that can occur from supply instabilities coming form the ballast. The ILF 400 also contains a superstructure 420 that provides physical support and a hollow structure to conceal cabling. The superstructure 420 is connected to the evaporator 430 of the thermo mechanical system. The evaporator 430 is then connected to the two condenser coils 440A and 440B.

Figure 3:
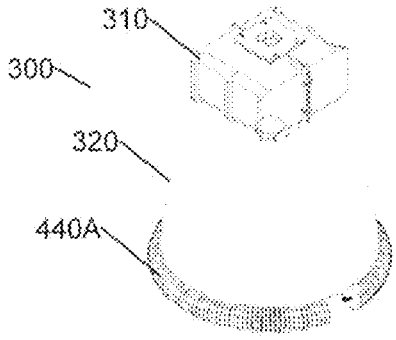
FIG. 3A illustrates a common metal halide fixture that is applied in high bay lighting applications the ILF installed.
FIG. 3B illustrates the ILF 400 as a standalone assembly without any portion of the metal halide fixture present.
Figure 3:
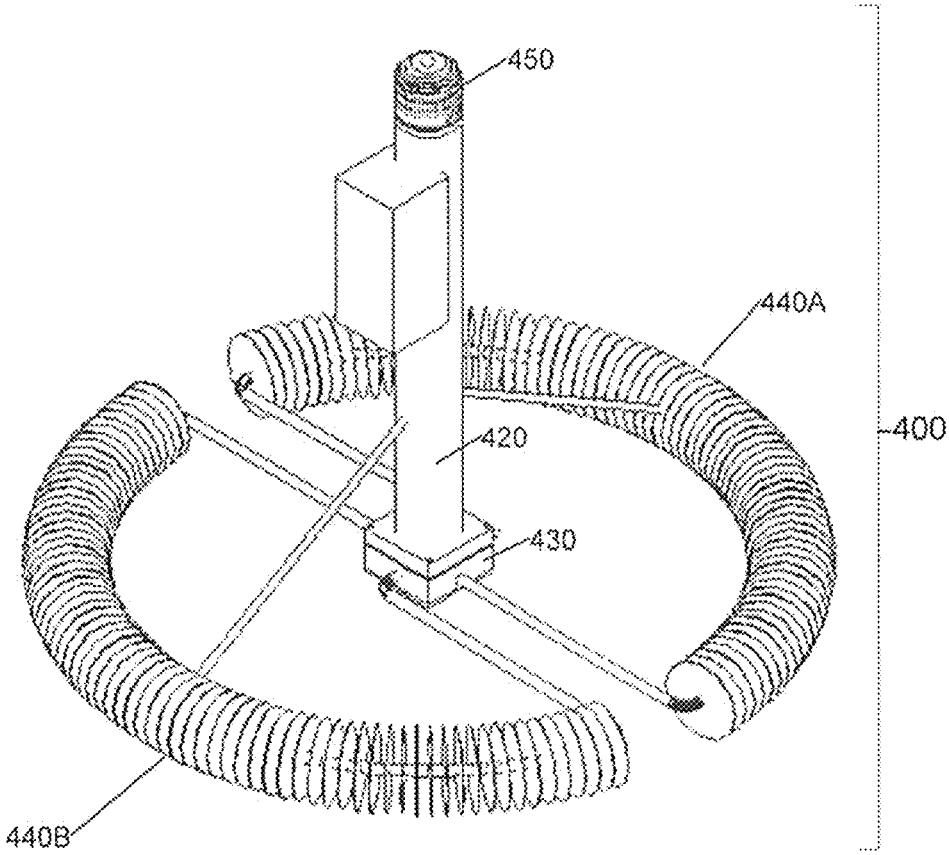

FIG. 3A illustrates a common metal halide fixture that is applied in high hay lighting applications the ILF installed. The when the ILF is installed in the metal halide fixture 300 the condenser coil 440A will sit below the reflector 320. These fins are atypical for a metal halide fixture but are present because the metal halide bulb has been replaced by the ILF.

FIG. 3B illustrates the ILF 400 as a standalone assembly without any portion of the metal halide fixture present. With this view the male E39 mogul base 450 can be seen which provides the electrical connection to the ballast 310. With the current invention the ILF can function by either screwing the ILF 400 into the ballast or opening the ballast 310 and bypassing the ballast system. In the current invention the height between the mogul base 450 and the evaporator 430 can be adjusted by telescoping the superstructure 420. This allows the ILF to be installed in different metal halide fixtures where the diameter or height of the reflector can vary.

Figure 4:
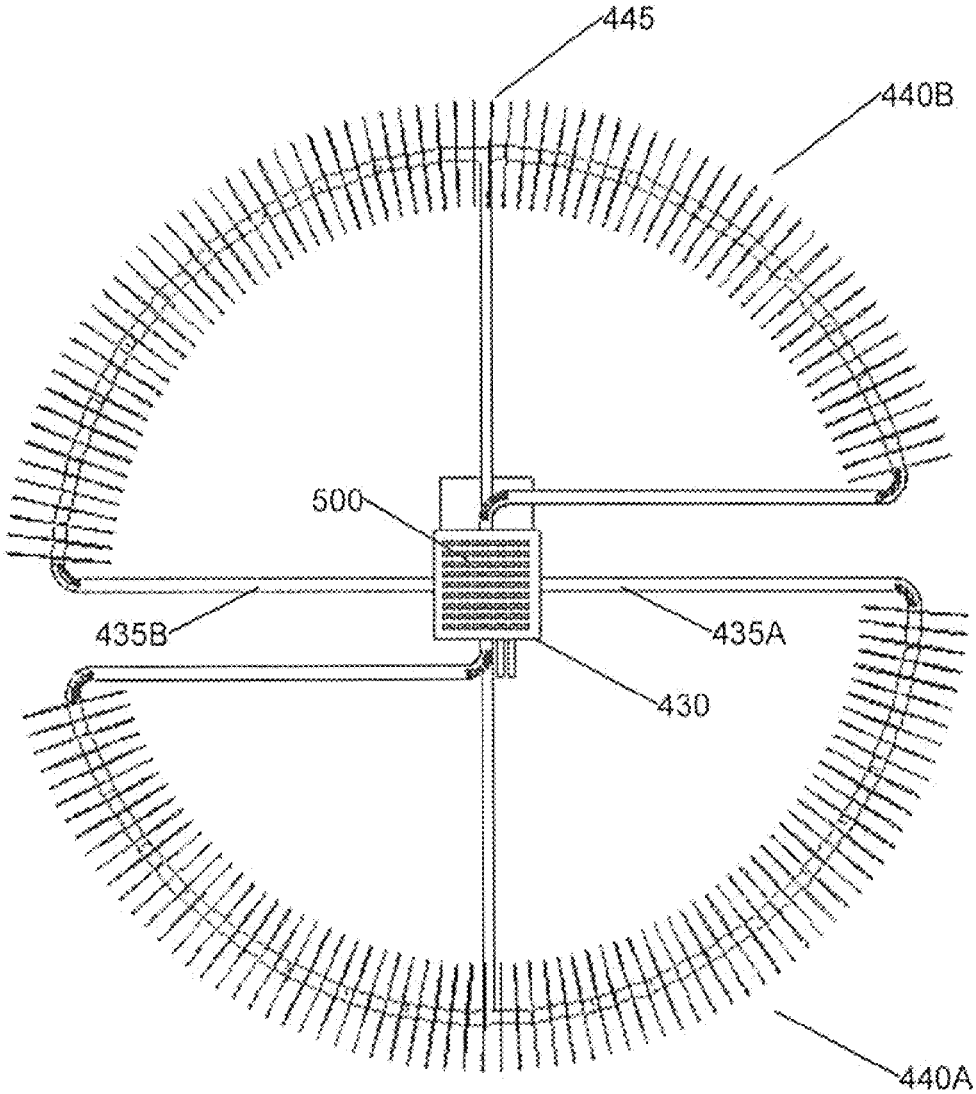
FIG. 4 illustrates the ILF pictured from the bottom looking up. From this vantage point the LED array 500 can be seen mounted to the evaporator 430 of the loop heat pipe.

FIG. 4 illustrates the ILF pictured from the bottom looking up. From this vantage point the LED array 500 can be seen mounted to the evaporator 430 of the loop heat pipe. In this thermo-mechanical design a large number of LEDs can be packaged in a dense array. This is atypical for LED luminaire design. Typically when packaging LEDs each package will have approximately 1 $in^2$ of area surrounding it on a metal core, board for proper thermal design. In the current invention the LEDs in array 500 can have little or no spacing as the loop heat pipe has very low thermal resistance of 0.5 C/W. This ultra low thermal resistance allows LEDs to be packaged into extreme brightness arrays. As heat originates from the LEDs it is conducted through the base of the LED. The energy is channeled to the evaporator 430 where the evaporation of a working fluid occurs. This phase transition stores the heat as latent heat carried by vapor. The vapor then travels to one of two vapor lines 435A or 435B. This presence of two vapor lines minimizes thermal resistance by reducing vapor flow restriction. The vapor begins to condense as it passes along the coils 440A and 440B. The latent heat is then released as the vapor changes phase back to liquid. A series of thin metallic fins 445 are placed along the condenser coil that act to release heat to the surrounding ambient air. The current invention is designed so that it is orientation independent since the condenser coils 440A/440B are redundant. Another novel feature of the disclosed design loop heat pipe design is that the thermal system weighs on the order of two pounds. This is important as there are weight limits on the mogul base.

Figure 5:
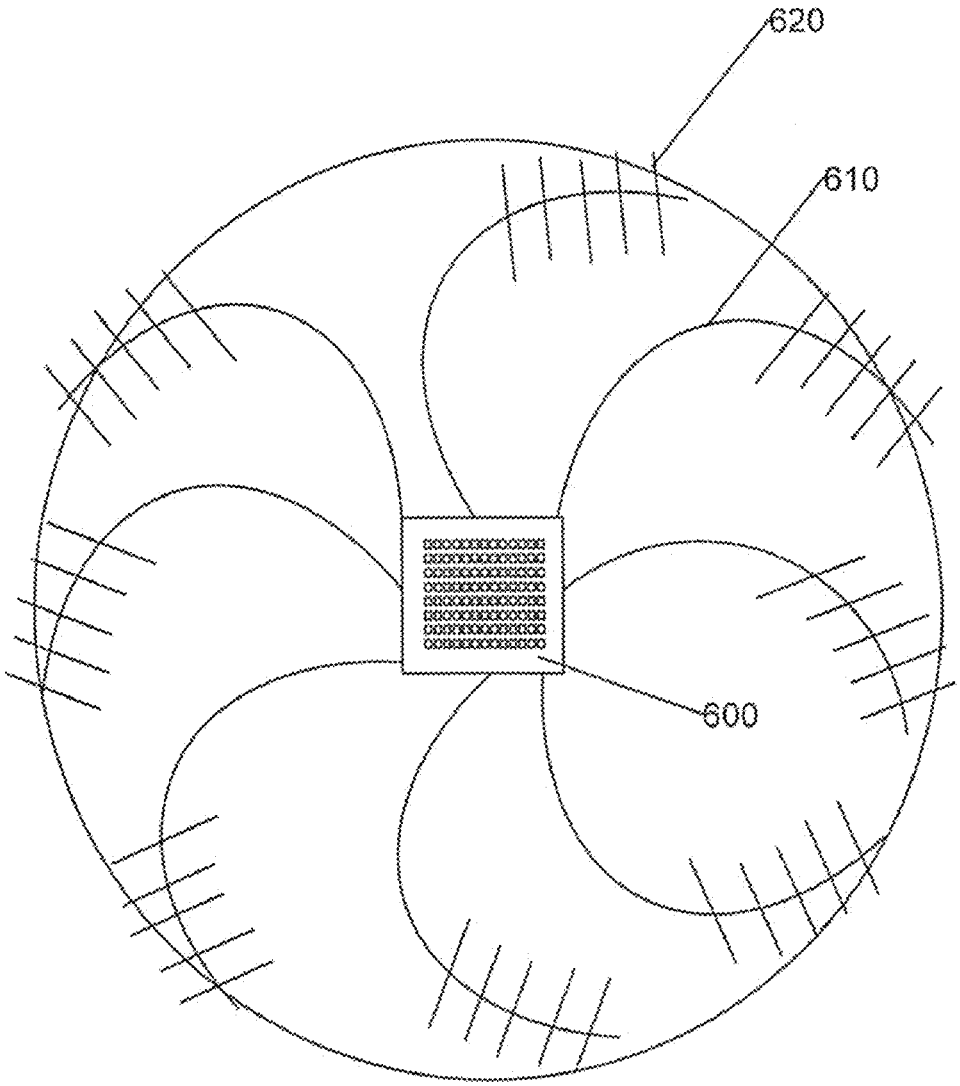
FIG. 5 illustrates an alternative embodiment where a heat pipe thermo-mechanical design can be utilized to achieve a ILF replacement bulb.

FIG. 5 illustrates an alternative embodiment where a heat pipe thermo-mechanical design can be utilized to achieve a ILF replacement bulb. For simplicity some of the functional elements of the ILF have not been detailed. In this design the replacement fixture has an LED array 600 that is thermally connected to a metallic saddle below the LED array. A series of heat pipes 610 are brazed to the saddle. The heat is communicated from the LED array to the saddle. The heat moves through the saddle to a series of heat pipes and within each heat pipe 610 phase change of a working fluid occurs thus carry the heat in the form of latent heat. Then on the distal end of the heat pipes the vapor recondensed to liquid thus releasing its stored heat. This heat is communicated to radial fins 620 that aid in convective heat transfer.

Figure 6:
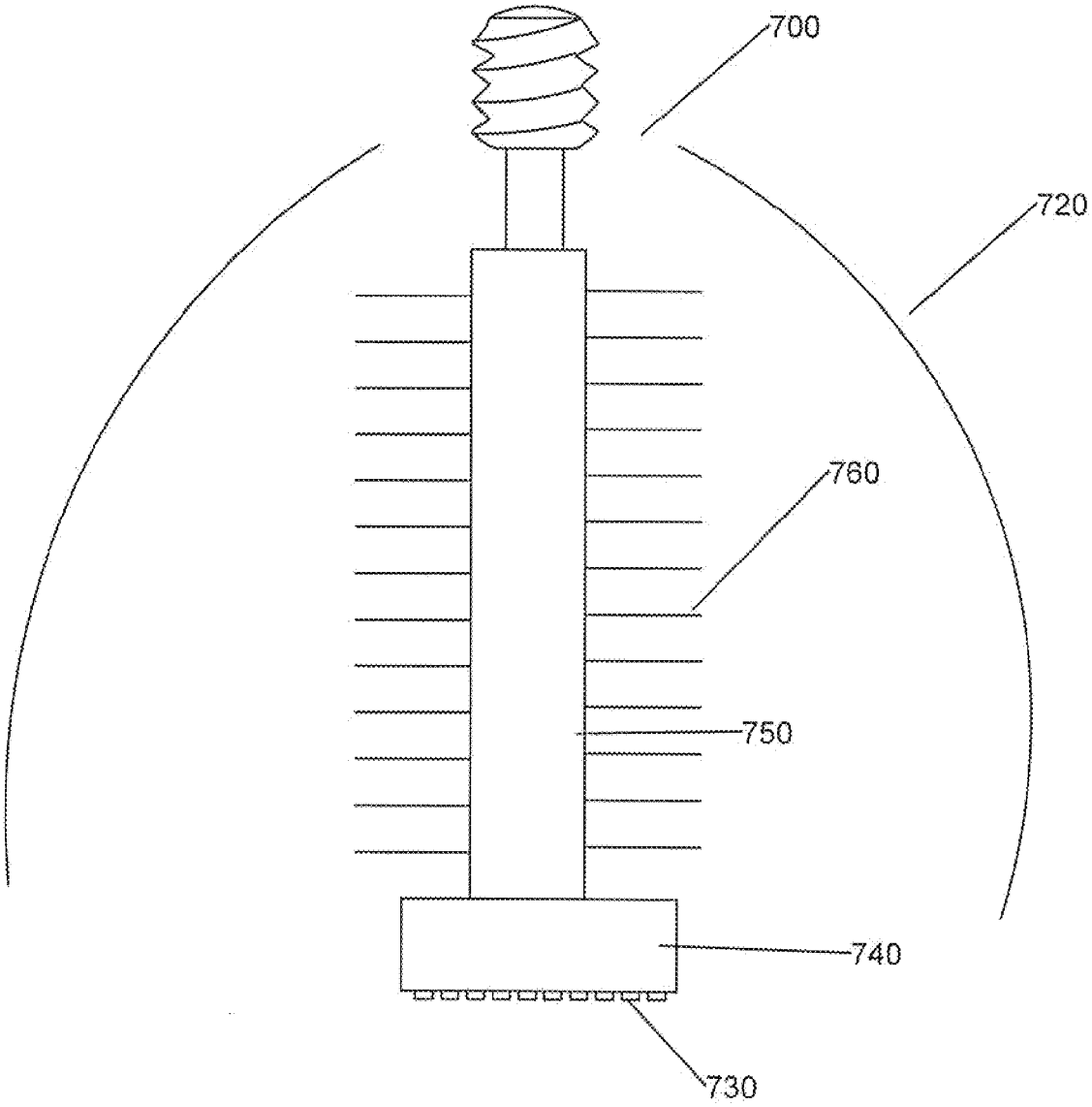
FIG. 6 illustrates an alternative embodiment where a thermosyphon is used as the thermo-mechanical design.

FIG. 6 illustrates an alternative embodiment where a themosyphon is used as the thermo-mechanical design. For simplicity some of the functional elements of the ILF have not been detailed. It is common for metal halide fixtures of the self cleaning type to have a vent hole 700 in the reflector 720 that allows dust to leave through hot convection currents. In the this case the LEDs are mounted to a boiling chamber 740. The boiling chamber sends vapor up along a hollow chamber 750 where it can condense and then drip back down by way of gravity. The vapor chamber is outfitted with metallic fins 760 that aid in the convective heat transfer of the heat.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above detailed description of embodiments of the disclosure is not intended to be exhaustive or to limit the teachings to the precise form disclosed above. While specific embodiments of, and examples for, the disclosure are described above for illustrative purposes, various equivalent modifications are possible within the scope of the disclosure, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed at different times. Further any specific numbers noted herein are only examples: alternative implementations may employ differing values or ranges.

The teachings of the disclosure provided herein can be applied to other systems, not necessarily the system described above. The elements and acts of the various embodiments described above can be combined to provide further embodiments.

Any patents and applications and other references noted above, including any that may be listed in accompanying filing papers, are incorporated herein by reference. Aspects of the disclosure can be modified, if necessary, to employ the systems, functions, and concepts of the various references described above to provide yet further embodiments of the disclosure.

These and other changes can be made to the disclosure in light of the above Detailed Description. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. §112, ¶6, other aspects may likewise be embodied as a means-plus-function claim, or in other forms, such as being embodied in a computer-readable medium. (Any claims intended to be treated under 35 U.S.C. §112, ¶6 will begin with the words "means for".) Accordingly, the applicant reserves the right to add additional claims after filing the application to pursue such additional claim forms for other aspects of the disclosure.

What is claimed is:

1. A lamp, comprising:

an LED array;

a light reflector;

a circular remote vapor condenser positioned below the light reflector, wherein the circular remote vapor condenser having at least one vapor line and at least one liquid line; and a thermo-mechanical system coupled to the LED array, wherein the thermo-mechanical system includes:

a top cap thermally coupled to the LED array, the top cap comprising one or more spaces to accommodate a vapor generated from a phase change of a liquid due to a heat emitted from the LED array;

a liquid-permeable porous structure coupled to the top cap, wherein the liquid-permeable porous structure causes a capillary force to move the vapor to the vapor line; and a liquid chamber coupled to the liquid-permeable porous structure and hydraulically coupled to the liquid line, wherein the chamber is configured to accommodate the liquid;

wherein the circular remote vapor condenser comprises a plurality of spiraling fins to increase a vapor path length to facilitate condensation of the vapor.

2. The lamp of claim 1, wherein the vapor is generated at a liquid meniscus of the liquid-permeable porous structure at a phase change temperature.

3. The lamp of claim 1, wherein the liquid chamber is configured to accommodate the liquid below a phase change temperature.

4. The lamp of claim 1, wherein the vapor condenses to a liquid form in the circular remote vapor condenser and returns to the liquid chamber via the liquid line.

5. The lamp of claim 1, wherein the vapor condenses to a liquid form in the circular remote vapor condenser and returns to the liquid chamber via the liquid line due to a thermodynamic pressure difference across the liquid-permeable porous structure.

6. The lamp of claim 1, wherein the vapor condenses to a liquid form in the circular remote vapor condenser and returns to the liquid chamber via the liquid line due to a gravity force.

7. The lamp of claim 1, wherein the circular remote vapor condenser comprises a heat sink.

8. The lamp of claim 7, wherein the heat sink comprises a plurality of metal fins.

9. The lamp of claim 1, wherein the liquid-permeable porous structure comprises a porous silicon wick.

10. The lamp of claim 1, further comprising:

a mogul base.

11. The lamp of claim 1, further comprising:

an E39 socket.

12. The lamp of claim 1, further comprising:

a power supply.

13. The lamp of claim 1, wherein the vapor condenses to a liquid form in the circular remote vapor condenser and spreads heat along a surface of a heat sink in an isothermal process.

14. A lamp, comprising:

an LED array emitting a light having at least 10,000 lumens from each square inch of an emitting surface of the LED array;

a light reflector;

a circular remote vapor condenser positioned below the light reflector;

a thermo-mechanical system hydraulically coupled to the circular remote vapor condenser and thermally coupled to the LED array, the thermo-mechanical system comprising a liquid-permeable porous structure; and a mogul base configured for connecting to a high intensity discharge fixture;

wherein a total weight of the lamp is less than five pounds.

15. The lamp of claim 14, wherein the circular remote vapor condenser having at least one vapor line and at least one liquid line; and wherein the thermo-mechanical system includes:

a top cap thermally coupled to the LED array, the top cap comprising one or more spaces to accommodate a vapor generated from a phase change of a liquid due to a heat emitted from the LED array;

the liquid-permeable porous structure coupled to the top cap, wherein the liquid-permeable porous structure causes a capillary force to move the vapor to the vapor line; and a liquid chamber coupled to the liquid-permeable porous structure and hydraulically coupled to the liquid line, wherein the chamber is configured to accommodate the liquid.

16. The lamp of claim 14, wherein the thermo-mechanical system comprising two-phase cooling device having a thermal resistance of less than 0.5 C/W.

17. The lamp of claim 14, wherein an efficacy of the lamp is at least 80 lumens per watt.

18. A method, comprising:

packaging surface mount LEDs of an LED array with a less than one inch spacing between the surface mount LEDs;

transferring a heat emitted from the LED array to a working fluid and causing a phase change of the working fluid to a vapor in an evaporator;

moving the vapor from the evaporator to a condenser via a vapor line, by a capillary force from a liquid-permeable porous structure in the evaporator, wherein the condenser comprises a plurality of spiraling fins to increase a vapor path length to facilitate condensation of the vapor;

condensing the vapor to the working fluid by exchanging heat from the vapor to an ambient air via a heat sink of the condenser; and returning the working fluid from the condenser to the evaporator via a liquid line.

19. The method of claim 18, wherein the working fluid is returned via the liquid line, by a thermodynamic pressure difference across the liquid-permeable porous structure, or by a gravity force.

20. The method of claim 18, further comprising:

emitting a light having at least 10,000 lumens from each square inch of an emitting surface of the LED array.

* * * * *